United States Patent [19]

Sano

[11] Patent Number: 4,887,763

[45] Date of Patent: Dec. 19, 1989

[54] TRANSMITTAL ARTICLE FOR MAGNETIC CARDS

[75] Inventor: Toshikazu Sano, Takamatsu, Japan

[73] Assignee: Shinnihon Printing Co., Ltd., Kagawa, Japan

[21] Appl. No.: 330,034

[22] Filed: Mar. 29, 1989

[51] Int. Cl.[4] ..... B65D 27/04

[52] U.S. Cl. ..... 229/71; 229/92.3; 229/92.8; 40/158.1

[58] Field of Search ..... 229/71, 92.3, 92.8; 40/156, 158.1, 159; 206/486

[56] References Cited

U.S. PATENT DOCUMENTS

| | | | |
|---|---|---|---|
| 2,256,399 | 3/1982 | MacHarg | 229/92.8 |
| 4,008,852 | 2/1977 | Davis | 229/92.3 |
| 4,237,633 | 12/1980 | Murrell | 229/92.8 |
| 4,531,316 | 7/1985 | Farnum | 229/71 |
| 4,559,727 | 12/1985 | Lewyt | 229/92.8 |
| 4,825,574 | 5/1989 | George | 40/158.1 |

FOREIGN PATENT DOCUMENTS

| | | | |
|---|---|---|---|
| 0013475 | 3/1906 | United Kingdom | 229/71 |
| 1341228 | 12/1983 | United Kingdom | 40/158.1 |

*Primary Examiner*—Stephen Marcus
*Assistant Examiner*—Kate Stemann
*Attorney, Agent, or Firm*—David H. Semmes

[57] ABSTRACT

Envelopes, particularly an envelope for mailing magnetic cards. The envelope includes a lower sheet of paper having an opening through which the magnetic card is exposed, a transparent film adhering to the rear surface of the lower sheet so as to cover the opening, and an upper sheet of paper mounted upon the lower sheet to cover the opening such that a magnetic card enclosure is defined by the upper sheet and lower sheet to receive and hold the magnetic card within the opening and such that the presence of the card within the envelope may be confirmed through the transparent sheet.

4 Claims, 3 Drawing Sheets

TRANSMITTAL ARTICLE FOR MAGNETIC CARDS

BACKGROUND OF THE INVENTION

1. Field of the Invention

The present invention relates to a transmittal article or envelope for mailing a magnetic card.

2. Description of the Prior Art

Recently, magnetic cards in the form of telephone charge cards have been frequently used in place of cash. In addition, the value of the magnetic card as a present or a gift has been popularized, such that magnetic cards are used variously as presents. In the case where these magnetic cards are sent as presents, a magnetic card is put into an envelope, or the corners of a magnetic card are inserted or affixed into slits formed in a pasteboard or mount, and the pasteboard is then inserted into an envelope, so that the magnetic card may not be displaced therein.

However, in the case where a magnetic card is sent with its main purpose as a present, a problem has been posed in that if an envelope and a pasteboard are used, various transmittal expenses are increased, resulting in unnecessary cost and cumbersome transmittal.

SUMMARY OF THE INVENTION

The present invention has been developed to overcome the above-described problems and provide a sending article or transmittal envelope for a magnetic card comprising a lower sheet of paper provided with an opening through which a magnetic card is exposed, a transparent film adhering to the rear surface of the lower sheet and an upper sheet of paper at least a part of which is mounted upon said lower sheet to cover the opening, characterized in that a magnetic card enclosure is defined by said upper sheet and said lower sheet to receive and hold the magnetic card between said opening and said upper sheet and thereby overcome the expense and cumbersome transmittal inherent in the prior art articles.

In the present invention, a magnetic card is received into and held by a receiving portion of a special envelope which may assume a form which is readily transmitted.

DESCRIPTION OF THE PREFERRED EMBODIMENTS

Figure 1:
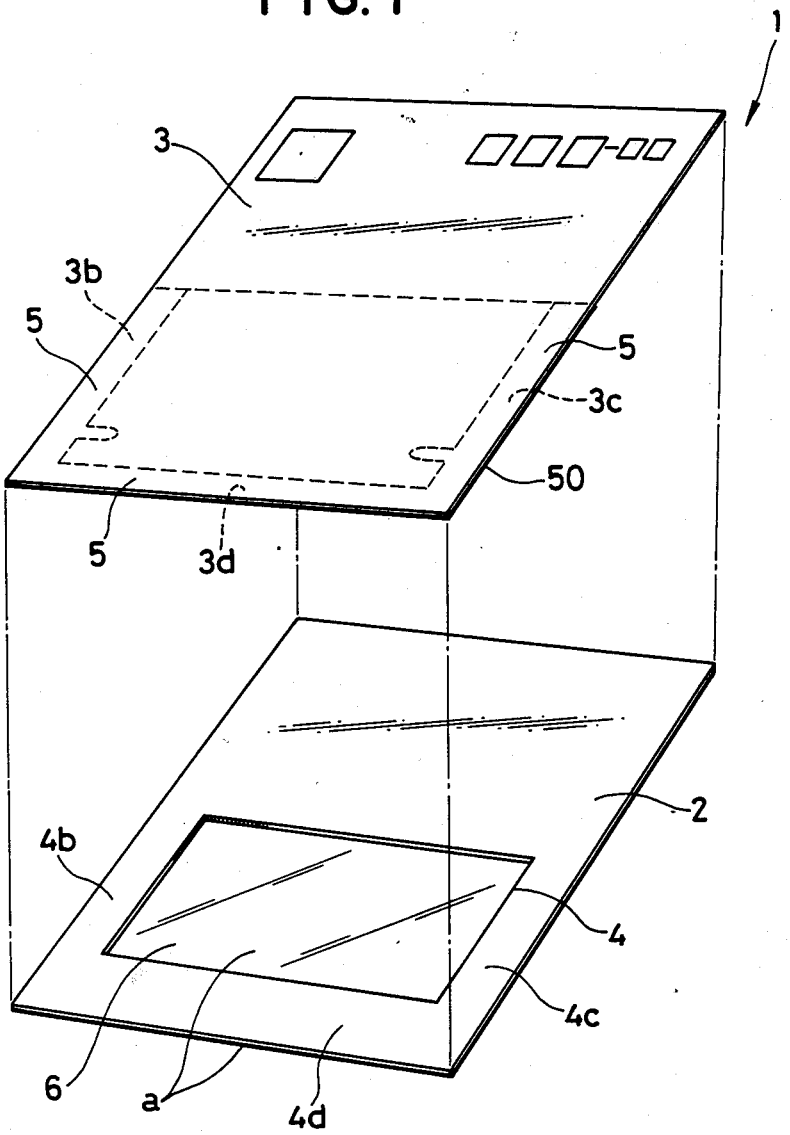
FIG. 1 is an exploded view, partially in phantom, showing one embodiment of a magnetic card sending envelope, according to the present invention.

In FIG. 1, magnetic card sending article or envelope 1 is formed in the size of a postcard as shown and comprises lower sheet of paper 2 having a thickness equal to that of a magnetic card and upper sheet of paper 3, having the same size as that of the lower sheet 2, and mounted at its ends on the upper surface of the lower sheet 2.

Lower sheet 2 is covered in its whole rear surface by transparent film a, lower sheet 2 being provided in its lower half portion with an opening 4 which is covered by said transparent film aand has a depth equal to that of the magnetic card and a configuration corresponding to the shape of the magnetic card. The aforesaid upper sheet 3 lower half is arranged in registry with corresponding opening 4.

Approximately the upper half portion of upper sheet 3 is adhered and secured to the lower sheet 2 via an adhesive (not shown). Upper sheet 3 lower half rear portion in registry with opening 4, includes a sealing means coated with an adhesive and the upper portion includes a peeling paper 50 positioned to cover the sealing means on both side edges 3*b*, 3*c* and a lower edge 3*d* of the upper sheet 3, corresponding to both side edges 4*b*, 4*c* and a lower edge 4*d* of the lower sheet opening 4. A magnetic card receiving portion 6 capable of being opened and closed is thusly formed between opening 4 and upper sheet 3.

It is noted that the adhesive for the upper half portion of the upper sheet and the adhesive constituting the sealing means are not required to be coated separately but one and the same adhesive can be used for coating simultaneously.

Figure 2:
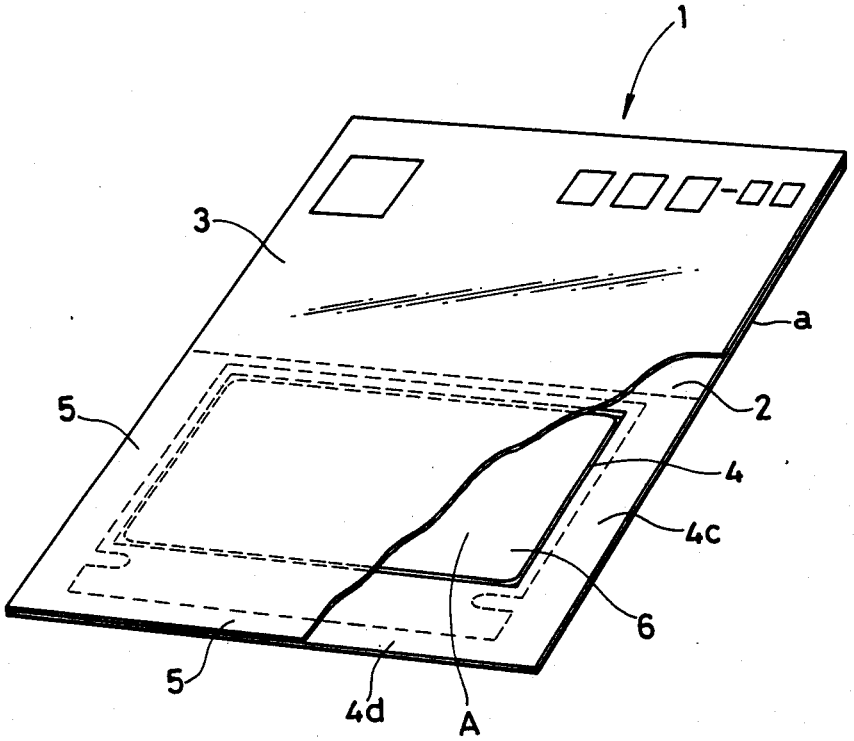
FIG. 2 is a perspective view.

In using the magnetic card sending envelope having the above-described construction, magnetic card receiving portion 6 is opened, magnetic card A is fitted into opening 4, the peeling paper 50 is then peeled away, and the upper sheet 3 and three peripheral edges 4*b*, 4*c*, 4*d* of the opening 4 may be pasted together by sealing means 5. Then, the magnetic card sending envelope is rendered in the envelope form wherein magnetic card A is received in and held by the magnetic card receiving portion 6, the four sides of which are sealed without moving magnetic card A. Magnetic card A and lower sheet 2 are aligned thereby on the same plane and magnetic card A can be mailed in a thin profile in which upper sheet 3 and transparent film are not deformed by magnetic card A. Thus, there is obtained a magnetic card sending article or envelope in which magnetic card A is exposed within opening 4 through transparent film a (see FIG. 2).

Figure 3:
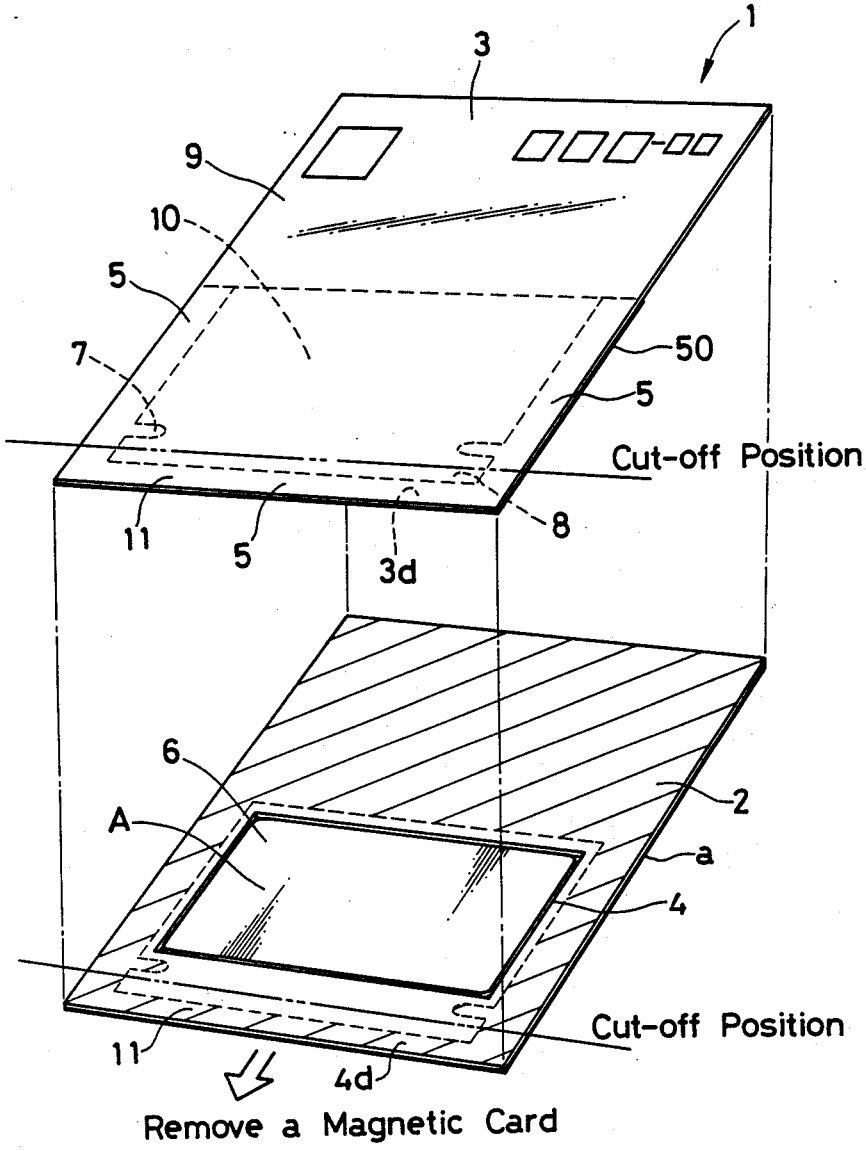
FIG. 3 is an exploded view, partially in phantom, showing the alignment of sealing surfaces of the lower and upper sheets.

As illustrated in FIG. 3, in removing magnetic card A, the adhesive or sealing means for upper sheet 3 exposed to lower sheet 2, having the opening 4, is merely coated on upper half portion 9, the lower half three peripheral edges 5 and stopper 7 defined in the rear of upper sheet 3. The surface corresponding to magnetic card receiving portion 10 of upper sheet 3 in contact with magnetic card A, receiving portion 6 and a portion of perforated or cutout portion 8 (see FIG. 3) defined in the lower portion of magnetic card sending envelope 1 to remove magnetic card A are not coated with adhesive. Therefore, when magnetic card A is removed after the cutout portion position has been torn off, the removal of magnetic card A may be facilitated, since lower portion 11 of the magnetic card transmittal envelope includes a portion of lower sheet 2 which does not adhere to either edge 3*d* of the upper sheet.

While in the above-described embodiment, a magnetic card sending envelope is illustrated in the size of a postcard, it is to be noted that the present invention is not limited thereto. The form of a double postcard, as well as the form wherein a plurality of portions are folded may also be employed.

As described above, and according to the present invention, the sending article or envelope comprises a lower sheet of paper provided with an opening which a magnetic card is exposed and an upper sheet of paper at least a part of which is mounted on said lower sheet to cover the opening, such that wherein a magnetic card receiving portion covered by said upper sheet and said lower sheet receives and holds the magnetic card between the opening and the upper sheet. Therefore, the magnetic card sending envelope containing a magnetic card is provided such that a simple operation places the magnetic card into the magnetic card receiving portion and the upper sheet is pasted to the lower sheet by a sealing means, for example. This magnetic card envelope is made into the size of a postcard whereby it can be mailed as a postcard, thus providing the economy of reducing various expenses required to send the magnetic card. Furthermore, the presence or absence of the thin magnetic card can be usually confirmed through the transparent film covering the opening, so as to render the transmittal operation positive, thus providing a practical and effective capability.

I claim:

1. A transmittal envelope for a magnetic card comprising:

a. a lower sheet of paper provided with an opening through which the magnetic card is exposed;

b. a transparent film adhering to a rear surface of said lower sheet, so as to cover said opening, and c. an upper sheet of paper at least a part of which is mounted upon said lower sheet, so as to cover said opening, characterized in that a magnetic card enclosure is defined by said upper sheet and said lower sheet to receive and hold the magnetic card within said opening, such that the presence of the card within the envelope may be confirmed through said transparent film.

2. A transmittal envelope for a magnetic card as in claim 1, including:

d. sealing means adhering to a portion of the rear surface of said upper sheet, so as to engage said lower sheet surrounding said opening and e. peel off cover means, affixed to said sealing means, so as to enable selective sealing as a card is inserted within said opening.

3. A transmittal envelope for a magnetic card as in claim 2, said upper sheet including a cutout portion without adhesive on its underside and in registry with said opening in the lower sheet so as to enable opening of the envelope and removal of the magnetic card.

4. A transmittal envelope for a magnetic card as in claim 2, said cutout portion overlaying a portion of said lower sheet below said opening, so as to facilitate removal of the magnetic card.

* * * * *